United States Patent [19]

Bloomfield

[11] Patent Number: 4,993,986

[45] Date of Patent: Feb. 19, 1991

[54] FUZZ BLOWER POWER TUBE

[76] Inventor: Steven L. Bloomfield, 1406 Jensen Dr., Pittsburg, Calif. 94565

[21] Appl. No.: 430,173

[22] Filed: Nov. 1, 1989

[51] Int. Cl.[5] ..... A63H 33/00; A63H 33/40; A63H 29/22; A63F 9/00

[52] U.S. Cl. ..... 446/140; 446/179; 446/484; 446/28; 273/1 E

[58] Field of Search ..... 446/140, 144, 176, 178, 446/179, 191, 194, 484, 485, 21, 28; 272/27 B; 273/1 E, 144 R

[56] References Cited

U.S. PATENT DOCUMENTS

| | | | |
|---|---|---|---|
| 1,455,473 | 5/1923 | Bolton | 446/140 |
| 2,018,585 | 10/1935 | Weil | 446/140 |
| 2,621,042 | 12/1952 | Stein et al. | 273/144 R X |
| 2,903,817 | 9/1959 | McLain et al. | 446/179 |
| 2,911,745 | 11/1959 | Simon | 446/179 X |
| 3,084,478 | 4/1963 | Burger | 441/140 |
| 3,158,955 | 12/1964 | Sturgis | 446/140 |
| 3,255,552 | 6/1966 | Salayka | 446/28 |
| 3,731,421 | 5/1973 | Frattolillo et al. | 446/128 |
| 3,778,927 | 12/1978 | Edden | 446/140 |
| 3,955,630 | 5/1976 | Thomas | 446/484 X |
| 4,045,906 | 9/1977 | Goldfarb et al. | 446/179 |
| 4,109,413 | 8/1978 | Brown | 446/140 |
| 4,221,074 | 9/1980 | Gonzalez | 446/28 |
| 4,250,657 | 2/1981 | Barlow et al. | 446/178 |
| 4,307,857 | 12/1981 | Godberson | 446/178 X |
| 4,553,748 | 11/1985 | Allen et al. | 273/1 E |
| 4,573,938 | 3/1986 | Sassak | 446/178 X |

FOREIGN PATENT DOCUMENTS

| | | | |
|---|---|---|---|
| 1509451 | 5/1978 | United Kingdom | 416/178 |

OTHER PUBLICATIONS

Besancon, The Encyclopedia of Physics, 1966, pp. 677-679, "Static Electricity".

*Primary Examiner*—Mickey Yu
*Assistant Examiner*—D. Neal Muir
*Attorney, Agent, or Firm*—Myers & Assoc., Ltd.

[57] ABSTRACT

The fuzz blower power tube of the present invention disclosed herein agitates floats in generally non laminar fluid flow to cause the floats to acquire a static charge. The charged floats repel each other and may cling to portions of the tube of opposite charge. The fuzz blower power tube includes as principal components a ventilated container, fluid, fan, motor and floats. The ventilatd container has an intake for receiving fluid within the container and an exhaust for expelling the fluid which flows through at least one of the means. The fan, causes the fluid to flow and transport the floats from a upstream to a downstream position and collide with each other and other portions of the container.

34 Claims, 2 Drawing Sheets

FUZZ BLOWER POWER TUBE

This fuzz blower power tube invention generally relates to the field of amusing and educational devices. The fuzz blower power tube invention particularly relates to amusing and educational devices which either employ fluid movement to agitate float or employ static electricity effects resulting in repulsion or attraction of electrified objects.

BACKGROUND OF THE INVENTION

It is supposed that from time immortal individuals have observed floats in turbulent and near turbulent flowing fluids for amusement and edification. Boys and men still throw wood into rapids to that end, and there is little doubt that a number of devices exist employing this phenomenon.

At least since the eighteenth century, static electricity effects have been observed for educational and amusement purposes. Franklin and others experimented with silk and glass which ultimately lead to Maxwell's equations, the foundation of the electrification of our civilization. The Encyclopedia of Physics, Besancon, published by Reinhold Publishing Corporation, 1966 includes an overview of applicable phenomena under the heading STATIC ELECTRICITY and is incorporated, with references and cross references, by reference.

A number of patents have been issued which relate to this phenomena. Among such patents are the following:

U.S. Pat. No. 3,731,421 issued to Frattolillo et al. on May 8, 1973 describing a DEVICE FOR SCATTERING LIGHT OBJECTS. This device is in essence a confetti blower.

U.S. Pat. No. 4,045,906 issued to Goldfarb et al. on Sept. 6, 1977 describing a PLAY DEVICE FOR SUSPENDING AND MOVING A FLOATABLE OBJECT RELATIVE TO MOVABLE AREAS. The Goldfarb et al. device suspends a ball in an air stream for moving the ball into areas defined in a movable structure.

U.S. Pat. No. 3,778,927 issued to Edden on Dec. 18, 1973 describing an AMUSEMENT AND EDUCATIONAL DEVICE. This device employs insulative balls which are shaken in a container until a static charge develops on the balls and on the insulative container walls. The balls are supported against the gravitational fields by clinging to the walls until the charge dissipates.

U.S. Pat. No. 3,084,478 issued to Burger on Apr. 9, 1963 describing a POPPING BALL TOP. The top includes an agitating paddle which causes associated balls to become statically charged and appear to float in the air as the balls repulse each other.

U.S. Pat. No. 3,158,955 issued to Sturgis on Dec. 1, 1964 describing a ROTATABLE TOY COMPRISING A CONTAINER FILLED WITH PARTICLES CREATING A SNOWFALL EFFECT. Particles, interior to the toy, acquire static charges as the toy rolls on a surface and adhere to the inner surface of the toy as a result.

U.S. Pat. No. 2,018,585 issued to Weil on Oct. 22, 1935 describing an ELECTROSTATIC FLYING TOY. The toy includes a foil airplane-shaped body repelled from a similarly charged component.

U.S. Pat. No. 1,455,473 issued to Bolton on May 15, 1923 describing a TOY employing statically charged figures attracted to a glass plane with tethered elements preventing the flat adhesion of the charged figures to the glass.

U.S. Pat. 4,109,413 issued to Brown on Aug. 29, 1978 describing a LEVITATION TOY AND METHOD OF OPERATION THEREOF concerns statically charged components of the same polarity, including a tube for launching a plurality of similarly charged objects.

It is not believed that any of the foregoing employ fluid turbulence and electrostatic effects at the same time.

SUMMARY OF THE INVENTION

The present fuzz blower power tube invention employs a ventilated container, a fluid in the container and agitation structure to cause fluid flow which carries floats in a random chaotic path from an upstream position within the container to a downstream position within the container. Advantageously, the floats and portions of the structure which the floats may contact are insulative so that agitation of the floats results in the floats acquiring a static charge and repel each other. The static charge acquired on the floats can result in the floats being attracted to portions of the structure of an opposite charge. Within the container, the movement of the fluid tends to overcome the electrostatic attraction of oppositely charged elements.

DETAILED DESCRIPTION OF THE DRAWING

Figure 1:
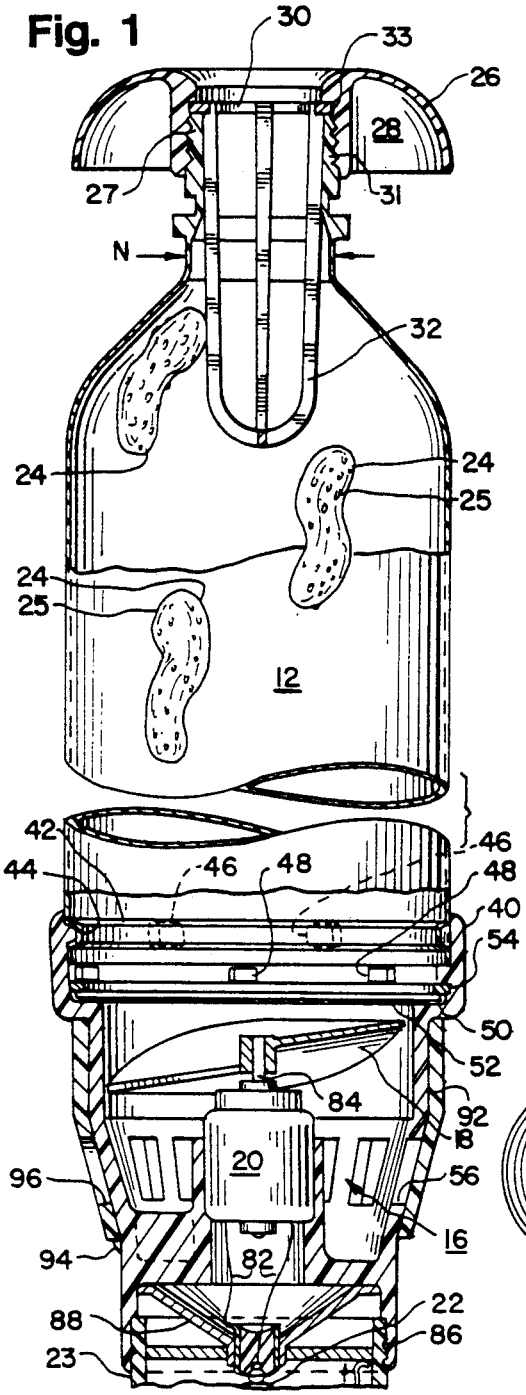
FIG. 1 is a fragmentary elevation of the present fuzz blower power tube invention partially in cross-section.

The present fuzz blower power tube invention 10 is shown in elevation and partial cross-section in FIG. 1 of the drawing. The invention includes a ventilated container 12 with intake means for receiving fluid into the container 12 and exhaust means for expelling fluid from the container 12. Container 12 is a generally elongated cylinder and includes tube wall 14 which is generally transparent and preferably fabricated from an insulative plastic tube wall material. Acrylic plastic is now preferred, but Polyethylene Terephthalate (PET) appears suitable. It is believed that tube wall 14 may be economically fabricated by modifying existing molds for plastic container bottles or altering such bottles.

A fluid (often transparent and therefore not shown) is disposed throughout container 12 entering through the intake means and exhausting through the exhaust means. The fluid is preferably atmospheric air.

Agitation means 16 for causing the fluid to flow is preferably disposed to one end of container 12 adjacent either the intake means or the exhaust means. Agitation means 16 includes propulsion means 18, illustrated as a fan prop, motor 20, and a power source means for energizing the motor illustrated as a battery 22 in battery case 23. The power source means selectively energizes motor 20 to cause the prop to rotate and cause fluid flow.

Floats 24 are transported in the flowing fluid. Floats 24 are of relatively low density and fabricated from insulative float material. Preferably, floats 24 are commonly available packing material such as polystyrene packing peanuts, or popcorn. The packing peanuts may be either smooth or have dimples 25 (irregularities in float surface), but it is believed that dimpled packing peanuts will respond to the quasi random flow of the fluid and perhaps acquire a stronger static charge producing observable effects somewhat more rapidly, probably due to increased normal forces in a collision. Floats 24 within container 12 may be viewed through generally transparent tube wall 14 or through a transparent portion of an otherwise translucent or opaque tube wall 14.

Exhaust cap 26 is releasably secured to tube wall 14 at an exhaust end 27 of tube wall 14. Exhaust cap 26 includes cap dish 28 which has an exhaust orifice 30 in the central part of cap dish 28. The exhaust orifice 30 acts as exhaust means and threadably mates with tube threads 31 on tube wall 14 for releasable securement to tube wall 14. Cap dish 28 tends to direct any float 24 exiting the interior of container 12 away from the exhaust orifice 30 so that float 24 may be attracted to the exterior of tube wall 14. Tube wall 14 tapers to a narrower diameter, indicated at N, in the region of exhaust cap 26 from a wider diameter, indicated at W, elsewhere. It is believed that the complexity and velocity of the fluid flow is therefore enhanced. Exhaust cap 26 further includes a separable buffer rail means for preventing float congestion in the region of the exhaust means without restricting fluid flow. Buffer rail means are provided by a plurality of buffer rails 32 extending from annular rail flange 33 into the wider diameter portion of tube wall 14 to form a cage which will not pass float 24. The buffer rail means is preferably integrally molded and separable from exhaust cap 26. The annular rail flange 33 is separate from threaded orifice 30 and trapped between exhaust cap 26 and the exhaust end 27 of tube wall 14. Float 24 is restrained within container 12 by buffer rails 32, when buffer rails 32 are present.

Figure 4:
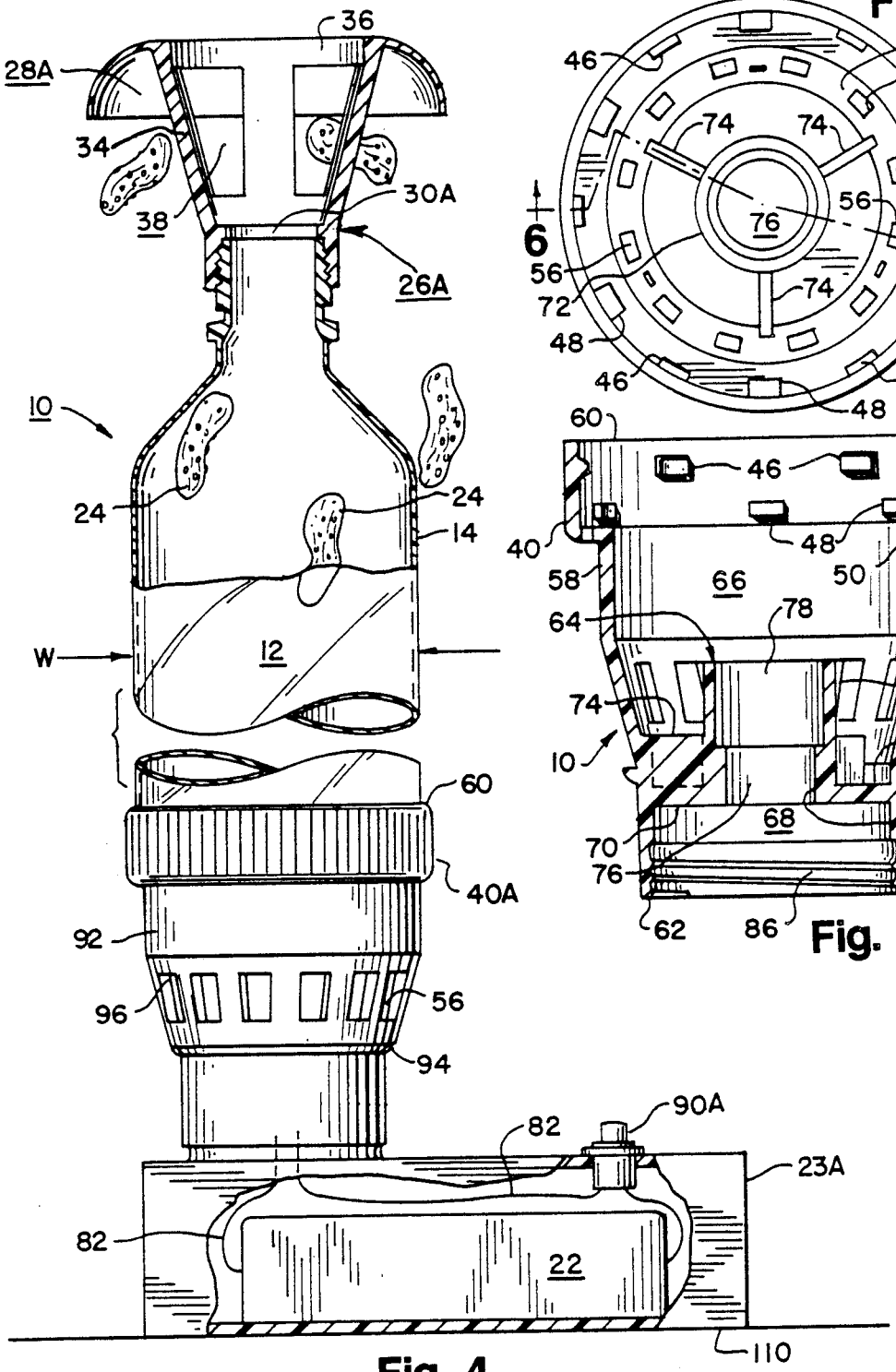
FIG. 4 is an elevation of a fourth alternate embodiment of the present fuzz blower power tube invention having partial cross-sections.
Figure 5:
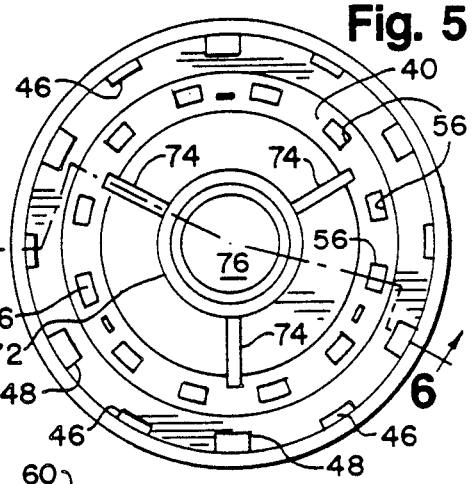
FIG. 5 is a top view of a component of the present fuzz blower power tube invention.

An alternate embodiment of exhaust cap 26 is shown in FIG. 4 as 26A. Similar aspects between exhaust cap 26A and exhaust cap 26 are identified with identical numerals with or without the suffix "A", respectively. The principal difference between the alternate embodiments of the exhaust cap is the elevation of cap dish 28A from exhaust orifice 30A by upwardly and outwardly tapering spacer rails 34. Exhaust cap 26A tends to collect floats 24 in the region of spacer rails 34 due to the reduction of fluid velocity in this region. Some floats 24 will escape through spacer orifice 36 or spacer rail orifice 38 to cling to the exterior of tube wall 14 in the absence of selectively detachable buffer means similar to that discussed above in connection with FIG. 1.

Figure 6:
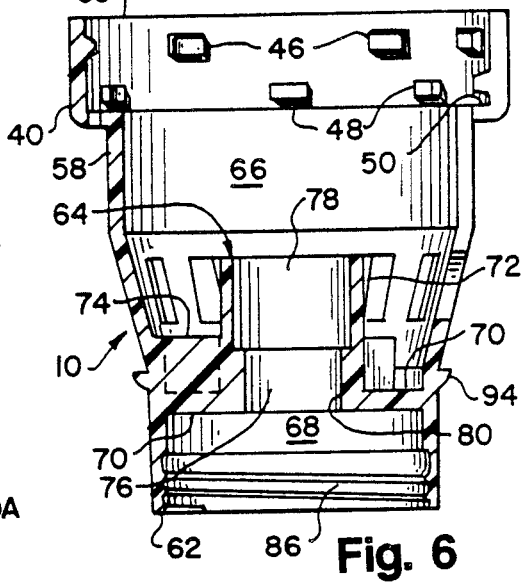
FIG. 6 is a cross-section side view of FIG. 5.

As shown in FIG. 1, intake adapter 40 is sealingly snap fitted to tube wall 14 adjacent intake end 42 opposite exhaust end 27. Intake adapter 40 is generally in the form of a double chambered, hollow cylinder, tapered toward the middle of its longitudinal extension, preferably molded in a suitable plastic. Wall groove 44 in tube wall 14 is disposed adjacent intake end 42 to receive groove dimples 46 on the interior of intake adapter 40 and secure tube wall 14 to intake adapter 40. To further prevent movement as a result of compression between tube wall 14 and intake adapter 40, a plurality of stop dimples 48 which may project further to the interior of intake adapter 40 abut intake end 42. Stop dimples 48, in cooperation with the interior of adapter shoulder 50, positively locate mesh screen 52 between them. Although mesh screen 52 may be of sufficient rigidity to be so located, it is preferred that tensioning snap ring 54 be adhered to the periphery of screen 52 to maintain screen in a generally planar attitude and more positively locate screen 52 within intake adapter 40. Screen 52 insures that floats 24 do not fall or migrate into intake adapter 42 to any significant degree without unduly restricting fluid flow. Fluid selectively enters container 12 thru intake orifice 56, piercing adapter wall 58 and is located toward the middle of adapter 40, between upper end 60 and lower end 62. Intake orifice 56 act as intake means for container 12, the aggregate area of intake orifice 56 should equal or exceed that of exhaust orifice 30 to avoid restricting fluid flow. Motor support structure 64, acting as means for mounting motor 20, generally divides the interior of adapter 40 into upper chamber 66 and lower chamber 68, as best seen in FIG. 6. Motor support structure 64 includes annular support disc 70, support tube 72 and support walls 74. Annular support disc 70 extends inwardly from adapter wall 58 and defines lead orifice 76. Support tube 72 surrounds lead orifice 76 and extends upwardly from the upper surface of support disc 70. Tube motor portion 78 has a diameter selected to grasp the cylindrical body of motor 20 and retain motor 20 in place. Tube lead portion 80 must have a diameter large enough to accommodate any lower motor structure protruding below the cylindrical body of motor 20 and allow motor leads 82 to be connected to power source 22. It is preferable that the entire motor 20, except motor shaft 84, be accommodated in tube motor portion 78 and tube lead portion 80. Propulsion means 18 is affixed to motor shaft 84 and accommodated in upper chamber 66, substantially occupying the entire space defined between adapter wall 58. Support walls 74 extend upwardly from support disc 70, between adapter wall 58 and support tube 72, to strengthen support structure 64.

Figure 2:
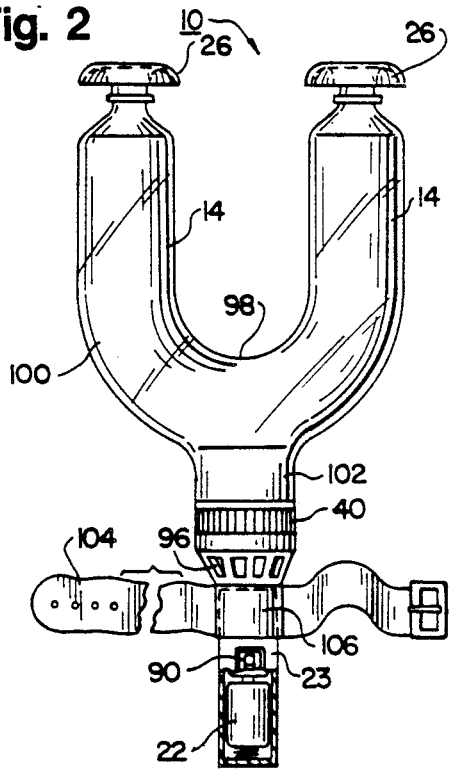
FIG. 2 is an elevation of an alternate embodiment of the present fuzz blower power tube invention partially in cross-section.

Intake adapter 40 is so denominated because it not only contains intake orifice 56, but also is adapted to threadably mate with a standard flashlight barrel acting as battery container 23, as best seen in the embodiments of FIG. 1 and 2. Threads 86 on the interior of adapter 40 adjacent lower end 62 mate with those on the flashlight barrel. Motor lead 82 are suitably connected to standard flashlight reflector assembly 88 and power source 22. Reflector assembly 88 is partially contained within lower chamber 68 in the embodiment shown. Switch 90 allows selective energization of motor 20 in a conventional manner.

An orifice collar 92 is rotatably affixed to the exterior of adapter 40 to act as orifice control means for selectively reducing the effective area of fluid flow through intake orifice 56. The collar 92 is positively located between the exterior of adapter shoulder 50 and adapter lugs 94 by being slid over lower end 62 until collar 92 is trapped between shoulder 50 and lugs 94.

A matching plurality of collar orifice 96 are selectively rotated into full alignment with intake orifice 56 or full misalignment with intake orifice 56 and intermediate positions to regulate fluid flow.

The embodiment of fuzz blower power tube 10 illustrated in FIG. 2 principally differs from that of FIG. 1 in that a manifold 98 is added to tube wall 14 resulting in two elongate tubes 100. The manifold area should at least equal the cross-sectional area of the elongate tubes 100 to avoid congesting fluid flow and preferably makes an appropriate gradual transition between tubes 100 and lower tube 102. The orientation and agitation of fuzz blower power tube 10 will selectively divert float 24 into one of tubes 100 in greater number than the other. Fuzz blower power tube belt 104 with belt loop 106 allows the fuzz blower power tube 10 to be selectively carried, or operated, or both, when it is belted about the waist of an operator.

Figure 3:
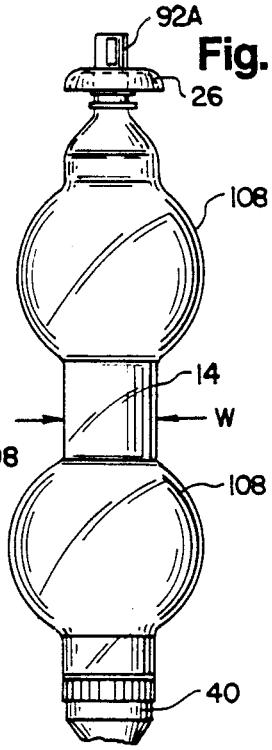
FIG. 3 is a fragmentary elevation of a second alternate embodiment of the present fuzz blower power tube invention.

The embodiment of fuzz blower power tube 10 shown in FIG. 3 includes two bulbs 108 and modified orifice collar 92A varying the effective area of exhaust orifice 30. Float 24 in the region of bulbs 108 move more slowly than those within the smaller diameter w and thereby provide a visual illustration of the Venturi effect.

Figure 3A:
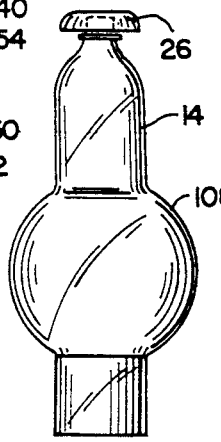
FIG. 3A is a fragmentary elevation of a third alternate embodiment of the present fuzz blower power tube invention.

The embodiment of fuzz blower power tube 10 in FIG. 3A has a single bulb 108.

The embodiment of fuzz blower power tube 10 in FIG. 4 in addition to having exhaust collar 26A, previously discussed, is a table top model having modified battery container 23A, intake adapter 40A and switch 90A. Battery container 23A includes flat base 110 which is of sufficient area to stabilize fuzz blower power tube 10 on a flat surface. Intake adapter 40A may be snap fitted onto battery container 23A in a manner similar to the fitting between tube wall 14 and adapter 40. Switch 90A is a momentary on push button switch.

As those skilled in the art will readily recognize, some of the elements or components described may be interchanged with others, and those shown as together may be separated, and vice versa, without adversely affecting the performance of the fuzz blower power tube.

From the foregoing description it will be apparent that modifications can be made to the fuzz blower power tube 10 of the present invention without departing from the teachings of the invention. Also, it will be appreciated that the invention has a number of advantages, some of which have been described above and others of which are inherent in the invention. Accordingly, the scope of the invention is only to be limited as necessitated by the accompanying claims.

I claim:

1. A fuzz blower power tube comprising:

a ventilated container having intake means for receiving fluid into said container and exhaust means for expelling fluid from said container displaced from each other and a transparent wall therebetween;

fluid disposed through said container and flowing through at least one of said intake means and exhaust means;

agitation means disposed adjacent one of said means for causing fluid flow of said fluid;

a light weight float transported from an upstream position to a downstream position by said fluid flow within said container, said float being freely movable within said container transparent wall;

said float sized to present a float cross section which is only a portion of the cross section of said container.

2. The fuzz blower power tube of claim 1 wherein said agitation means includes propulsion means for agitating said fluid;

an electric powered motor causing rotation of said propulsion means; and a power source operatively connected to said motor; and said float being fabricated from insulative float material and said container at least in said transparent wall portion being fabricated from other insulative material, said float material and said other insulative material being in a triboelectric series.

3. The fuzz blower power tube of claim 2 wherein;

said propulsion means is a fan prop;

said motor is powered by direct current; and said power source includes a battery and a battery container.

4. The fuzz blower power tube of claim 3 wherein:

said container includes a generally elongate tube having a transparent tube wall disposed between an exhaust end and an intake end;

an exhaust cap secured to said tube wall at the exhaust end of said tube wall;

an intake adapter secured to said tube wall at the intake end of said tube wall;

said intake means is at least one intake orifice in said intake adapter;

said exhaust means is at least one exhaust orifice in said exhaust cap;

said fluid is ambient atmospheric air;

said fan prop is disposed downstream from said intake orifice and secured within said intake adapter;

said motor is secured within said intake adapter upstream of said fan prop;

said battery container is a flashlight barrel with lens cap and bulb removed and includes an operative switch for selectively providing power to said motor within said intake adapter to which said battery container is secured; and further including a mesh screen disposed downstream of said fan prop.

5. The fuzz blower power tube of claim 4 wherein said float is fabricated from insulative float material, and other elements of said fuzz blower power tube disposed from said mesh screen to include said exhaust cap which may contact said float are fabricated from other insulative material, said insulative float material and said other insulative material being in a triboelectric series.

6. The fuzz blower power tube of claim 5 wherein said tube is acrylic; and said float is polystyrene.

7. The fuzz blower power tube of claim 5 wherein said tube is polyethylene terephthalate and said float is polystyrene.

8. The fuzz blower power tube of claim 5 wherein:

said tube wall tapers to a narrower diameter at the exhaust end;

said exhaust cap includes buffer rail means for preventing float from congesting the flow of fluid; and said container further includes an orifice control means for selectively decreasing the area of an orifice.

9. The fuzz blower power tube of claim 8 wherein:

said orifice control means is an orifice collar on said exhaust cap, selectively adjustable to open and close said exhaust orifice.

10. The fuzz blower power tube of claim 8 wherein:

said orifice control means is an orifice collar on said intake adapter selectively adjustable to open and close said intake orifice.

11. The fuzz blower power tube of claim 8 wherein:

said buffer rail means is a plurality of buffer rails intruding into the inside diameter portion of tube wall, and said buffer rails are detachable from said exhaust cap.

12. The fuzz blower power tube of claim 2 further including a generally elongate cylindrical tube having a transparent tube wall disposed between an exhaust end and an intake end.

13. The fuzz blower power tube of claim 12 further including a second generally elongate cylindrical tube disposed between an exhaust end and an intake end.

14. The fuzz blower power tube of claim 13 further including a belt allowing the fuzz blower power tube to be secured about the waist of an operator.

15. The fuzz blower power tube of claim 12 wherein said tube includes a bulb shape in said tube wall.

16. The fuzz blower power tube of claim 2 further including:

a generally elongate tube having a transparent tube wall disposed between an exhaust end and an intake end;

an exhaust cap secured to said tube wall at the exhaust end of said tube wall;

an intake adapter secured to said tube wall at the intake end of said tube wall;

said intake means is at least one intake orifice in said intake adapter;

said exhaust means is at least one exhaust orifice in said exhaust cap;

said fluid is ambient atmospheric air;

said fan prop is disposed downstream from said intake orifice and secured within said intake adapter;

said motor is secured within said intake adapter upstream of said fan prop; and a flat base operatively connected to said intake adapter to maintain said fuzz blower power tube in an upright orientation on a horizontal surface.

17. The fuzz blower power tube of claim 16 wherein:

said tube has a narrowed diameter at the exhaust end, said diameter being sufficiently wide to allow passage of a float; and said exhaust cap includes, a cap dish, and spacer rails elevate said cap dish above the exhaust end of said tube.

18. The fuzz blower power tube of claim 4 wherein:

said tube has a narrowed diameter at the exhaust end; and said exhaust cap includes, a cap dish, and spacer rails elevate said cap dish above the exhaust end of said tube.

19. The fuzz blower power tube of claim 4 wherein said tube wall includes a tube groove adjacent the intake end; and said intake adapter further includes groove dimples adjacent an upper end;

stop dimples disposed below said groove dimples, said tube being snap fitted onto said intake adapter by having said groove dimples received in said tube groove and said stop dimples abutting said intake end; and an adapter shoulder; and said fuzz blower power tube further includes a tensioning snap ring affixed to the periphery of said mesh screen tending to maintain said mesh screen in a planar orientation, said tensioning snap ring being positively located within said intake adapter by being trapped between said stop dimples and said adapter shoulder.

20. The fuzz blower power tube of claim 1 further including a float center of gravity, said float being asymmetrical about at least two orthogonal axis crossing at the center of gravity.

21. The fuzz blower power tube of claim 20 wherein said float is elongate and further including a dimpled float surface.

22. The fuzz blower power tube of claim 2 wherein:

said propulsion means is a fan prop, said fan prop having a fan axis of rotation; and said container between said intake means and said exhaust means primarily consists of a general elongate cylindrical tube having a transparent tube wall disposed between an exhaust end and an intake end, said tube having a cylindrical axis generally parallel to and aligned with the fan axis of rotation.

23. A fuzz blower power tube comprising:

a generally elongate tube having a transparent tube wall disposed between an exhaust end and an intake end;

an exhaust cap secured to said tube wall at the exhaust end of said tube wall;

an intake adapter secured to said tube wall at the intake end of said tube wall;

at least one intake orifice in said intake adapter;

at least one exhaust orifice in said exhaust cap;

ambient atmospheric air disposed within said tube and intake adapter and flowing between said intake orifice and exhaust orifice;

a light weight float transported from an upstream position to a downstream position by said air flowing between said intake orifice and said exhaust orifice;

a fan prop is disposed downstream from said intake orifice and secured within said intake adapter to cause said air to flow;

a motor is secured within said intake adapter upstream of said fan prop and powering said fan prop;

a battery selectively providing power to said motor;

a battery container in the form of a flashlight barrel with lens cap and bulb removed and includes said battery and an operative switch for selectively providing power to said motor within said intake adapter to which said battery container is secured; and mesh screen disposed downstream of said fan prop.

24. The fuzz blower power tube of claim 23 wherein said float is fabricated from insulative float material, and other elements of said fuzz blower power tube disposed from said mesh screen to include said exhaust cap which may contact said float are fabricated from other insulative material, said insulative float material and said other insulative material being in a triboelectric series.

25. The fuzz blower power tube of claim 24 wherein said tube is acrylic; and said float is polystyrene.

26. The fuzz blower power tube of claim 24 wherein said tube is polyethylene terephthalate and said float is polystyrene.

27. The fuzz blower power tube of claim 24 wherein:

said tube wall tapers to a narrower diameter at the exhaust end;

said exhaust cap includes buffer rail means for preventing float from congesting the flow of fluid; and said container further includes an orifice control means for selectively decreasing the area of an orifice.

28. The fuzz blower power tube of claim 27 wherein:
said orifice control means is an orifice collar on said exhaust cap, selectively adjustable to open and close said exhaust orifice.

29. The fuzz blower power tube of claim 27 wherein:
said orifice control means is an orifice collar on said intake adapter selectively adjustable to open and close said intake orifice.

30. The fuzz blower power tube of claim 27 wherein:
said buffer rail means is a plurality of buffer rails intruding into the inside diameter portion of tube wall, and said buffer rails are detachable from said exhaust cap.

31. The fuzz blower power tube of claim 23 wherein:
said tube has a narrowed diameter at the exhaust end; and
said exhaust cap includes,
a cap dish, and
spacer rails elevate said cap dish above the exhaust end of said tube.

32. The fuzz blower power tube of claim 23 wherein
said tube wall includes a tube groove adjacent the intake end; and
said intake adapter further includes
groove dimples adjacent an upper end;
stop dimples disposed below said groove dimples, said tube being snap fitted onto said intake adapter by having said groove dimples received in said tube groove and said stop dimples abutting said intake end; and
an adapter shoulder; and
said fuzz blower power tube further includes
a tensioning snap ring affixed to the periphery of said mesh screen tending to maintain said mesh screen in a planar orientation, said tensioning snap ring being positively located within said intake adapter by being trapped between said stop dimples and said adapter shoulder.

33. A fuzz blower power tube comprising:
a ventilated container having intake means for receiving fluid into said container and exhaust means for expelling fluid from said container displaced from each other and a transparent wall therebetween including, a generally elongate cylindrical tube having a transparent tube wall disposed between an exhaust end and an intake end and a second generally elongate cylindrical tube disposed between an exhaust end and an intake end;
fluid disposed through said container and flowing through at least one of said intake means and exhaust means;
propulsion means for agitating said fluid;
an electric powered motor causing rotation of said propulsion means;
a power source operatively connected to said motor;
a light weight float transported from an upstream position to a downstream position by said fluid flow within said container; and
a belt allowing the fuzz blower power tube to be secured about the waist of an operator.

34. A fuzz blower power tube comprising:
a ventilated container having intake means for receiving fluid into said container and exhaust means for expelling fluid from said container displaced from each other and a transparent wall therebetween including, a generally elongate cylindrical tube having a transparent tube wall disposed between an exhaust end and an intake end, said tube including a bulb shape in said tube wall;
fluid disposed through said container and flowing through at least one of said intake means and exhaust means;
propulsion means for agitating said fluid;
an electric powered motor causing rotation of said propulsion means;
a power source operatively connected to said motor; and
a light weight float transported from an upstream position to a downstream position by said fluid flow within said container.

* * * * *